US008800943B2

(12) United States Patent
Long

(10) Patent No.: US 8,800,943 B2
(45) Date of Patent: Aug. 12, 2014

(54) VENTILATING FAN MOUNTING BRACKET

(75) Inventor: Min Long, Guangdong (CN)

(73) Assignees: Panasonic Ecology Systems Guangdong Co., Ltd., Foshan, Guangdong (CN); Panasonic Corporation, Osaka (JP)

( * ) Notice: Subject to any disclaimer, the term of this patent is extended or adjusted under 35 U.S.C. 154(b) by 0 days.

(21) Appl. No.: 13/634,654

(22) PCT Filed: Jul. 9, 2010

(86) PCT No.: PCT/CN2010/001029

§ 371 (c)(1),
(2), (4) Date: Oct. 11, 2012

(87) PCT Pub. No.: WO2011/113185

PCT Pub. Date: Sep. 22, 2011

(65) Prior Publication Data

US 2013/0026334 A1 Jan. 31, 2013

(30) Foreign Application Priority Data

Mar. 17, 2010 (CN) ..... 2010 1 0130191

(51) Int. Cl.
*E04G 25/00* (2006.01)

(52) U.S. Cl.
USPC ..... 248/200.1; 248/342; 248/343; 248/323; 248/300

(58) Field of Classification Search
USPC ..... 248/906, 300, 200, 201, 200.1, 205.1, 248/56, 57, 68.1, 342, 343, 323; 52/28, 27, 52/742.1, 745.16, 745.15; 362/147, 148, 362/150, 365, 96
See application file for complete search history.

(56) References Cited

U.S. PATENT DOCUMENTS 4,799,638 A * 1/1989 Allen ..... 248/311.2
5,588,737 A * 12/1996 Kusmer ..... 362/148

(Continued)

FOREIGN PATENT DOCUMENTS

CN 2531603 1/2003
CN 1940310 4/2007

(Continued)

OTHER PUBLICATIONS

International Search Report for International Application No. PCT/CN2010/001029, dated Dec. 30, 2010.

(Continued)

*Primary Examiner* — Nkeisha Smith
(74) *Attorney, Agent, or Firm* — RatnerPrestia

(57) ABSTRACT

Disclosed is a mounting bracket assembly for a ventilating fan including a first bracket, a second bracket, and a bracket fixing member, the first bracket is provided with a U-shaped groove and is provided at an end thereof with a first supporting leg folded into an L-shaped; the second bracket is provided with a U-shaped groove and is provided at an end thereof with a second supporting leg folded into an L-shaped, and a root portion of the second supporting leg is provided at two sides thereof with slots; the second bracket is engaged into the U-shaped groove of the first bracket and can be slid in the U-shaped groove of the first bracket to adjust the length of the bracket assembly; the bracket fixing member is provided with a C-shaped groove; the first bracket is engaged and inserted into the C-shaped groove and can be slidable in the C-shaped groove; the bracket fixing member fixes the first bracket and the second bracket combined together to a ventilating fan body by engagement of the C-shaped groove with the first bracket. With the above configuration, the bracket assembly has improved stability, can be operated easily, and can be installed conveniently.

11 Claims, 5 Drawing Sheets

(56) References Cited

U.S. PATENT DOCUMENTS

| | | | | |
|---|---|---|---|---|
| 5,954,304 | A * | 9/1999 | Jorgensen | 248/200.1 |
| 6,004,011 | A * | 12/1999 | Sieczkowski | 362/365 |
| 6,220,557 | B1 * | 4/2001 | Ziaylek et al. | 248/316.1 |
| 6,519,791 | B2 * | 2/2003 | Randolph | 4/695 |
| 6,632,006 | B1 * | 10/2003 | Rippel et al. | 362/366 |
| 6,729,083 | B1 * | 5/2004 | Soyko | 52/220.8 |
| 6,768,071 | B1 * | 7/2004 | Gretz | 200/297 |
| 6,838,618 | B2 * | 1/2005 | Newbold et al. | 174/50 |
| 6,967,284 | B1 * | 11/2005 | Gretz | 174/58 |
| 7,191,994 | B2 * | 3/2007 | Johnson et al. | 248/343 |
| 7,216,838 | B1 * | 5/2007 | Gretz | 248/200.1 |
| 7,355,118 | B1 * | 4/2008 | Gretz | 174/58 |
| 7,429,021 | B2 * | 9/2008 | Sather et al. | 248/201 |
| 7,654,495 | B2 * | 2/2010 | Adrian et al. | 248/200.1 |
| 7,784,754 | B2 * | 8/2010 | Nevers et al. | 248/200.1 |
| 7,841,135 | B2 * | 11/2010 | Newbold et al. | 52/28 |
| 7,857,275 | B2 * | 12/2010 | de la Borbolla | 248/342 |
| 7,952,022 | B2 * | 5/2011 | Rippel et al. | 174/50 |
| 8,277,090 | B2 * | 10/2012 | Fryzek et al. | 362/366 |
| 8,403,277 | B2 * | 3/2013 | Nuernberger et al. | 248/200.1 |
| 8,434,916 | B2 * | 5/2013 | Craw et al. | 362/373 |
| 2003/0006353 | A1 * | 1/2003 | Dinh et al. | 248/343 |
| 2005/0045793 | A1 * | 3/2005 | Johnson et al. | 248/343 |
| 2006/0243877 | A1 * | 11/2006 | Rippel | 248/343 |
| 2006/0261235 | A1 * | 11/2006 | Rippel et al. | 248/343 |
| 2010/0006723 | A1 * | 1/2010 | Yan | 248/201 |
| 2010/0089000 | A1 * | 4/2010 | Adrian et al. | 52/745.21 |
| 2011/0240675 | A1 * | 10/2011 | McDoanald | 222/180 |

FOREIGN PATENT DOCUMENTS

| | | |
|---|---|---|
| JP | 8303382 | 11/1996 |
| JP | 2007315708 | 12/2007 |

OTHER PUBLICATIONS

Written Opinion for International Application No. PCT/CN2010/001029, dated Dec. 30, 2012.

* cited by examiner

VENTILATING FAN MOUNTING BRACKET

CROSS-REFERENCE TO RELATED APPLICATIONS

This application claims the benefit of PCT international application PCT/CN2010/001029, which was filed on Jul. 9, 2010, and which is incorporated herein in its entirety by reference.

BACKGROUND OF THE INVENTION

1. Field of the Disclosure

The present invention relates to a mounting bracket assembly, and more particular, to a mounting bracket assembly for a ventilating fan.

2. Description of the Related Art

FIG. 1 shows an existing mounting bracket assembly 100 for a ventilating fan 10, comprising two first brackets 110, two second brackets 120, and a bracket fixing member 130 fixed to a side of a body of the ventilating fan. The first end (not shown) of the first bracket 110 and the first end (not shown) of the second bracket 120 are inserted from the two ends of the bracket fixing member 130, respectively, and are connected with each other. The second end 112 of the first bracket 110 and the second end 122 of the second bracket 120 are fixed onto joists 200. In order to conform to different distances between the joists 200, a structure with an adjustable length is provided between the first bracket 110 and a second bracket 120. With this mounting bracket, the ventilating fan 10 can be mounted at the intermediate position between the joists 200 or at a desirable position by a user.

SUMMARY OF THE DISCLOSURE

In order to securely fix a heavy body of a ventilating fan at any position on a joist of a ceiling, it is desirable to provide a mounting bracket which ensures stability and can be installed easily and conveniently.

According to an aspect of the invention, there is provided a mounting bracket assembly for a ventilating fan, comprising a first bracket, a second bracket, and a bracket fixing member, the first bracket is provided with a U-shaped groove and is provided at an end thereof with a first supporting leg folded into an L-shaped; the second bracket is provided with a U-shaped groove and is provided at an end thereof to with a second supporting leg folded into an L-shaped, and a root portion of the second supporting leg is provided at two sides thereof with slots; the second bracket is engaged into the U-shaped groove of the first bracket and can be slidable in the U-shaped groove of the first bracket to adjust the length of the bracket assembly; the bracket fixing member is provided with a C-shaped groove; the first bracket and the second bracket combined together are engaged and inserted into the C-shaped groove of the bracket fixing member from a side of the C-shaped groove of the bracket fixing member and can be slidable in the C-shaped groove; the bracket fixing member is engaged with the first bracket by the C-shaped groove and the first bracket and the second bracket combined together are fixed to a ventilating fan body.

The U-shaped groove of the first bracket is provided with a convex face and a concave face used as an outside and an inside, respectively, and is provided with elongated openings formed along the horizontal direction and through the convex face and the concave face; a convex face of the U-shaped groove of the second bracket has a width that is narrower than a width of the concave face of the U-shaped groove of the first bracket, and the convex face of the U-shaped groove of the second bracket is provided with holes; the convex face of the U-shaped groove of the second bracket and the concave face of the U-shaped groove of the first bracket overlap each other; the first bracket and the second bracket are connected by passing screws from the elongated openings of the bracket through the holes of the second bracket.

The elongated openings of the first bracket comprise a plurality of elongated openings; the holes of the second bracket comprise a plurality of holes; a gap between at least two elongated openings of the plurality of elongated openings of the first bracket is narrower than a gap between any two holes of the second bracket.

A side of the first supporting leg of the first bracket and a side of the second support leg of the second bracket are provided with a flange portion, respectively, having holes thereon.

Two horizontal end faces, formed by being bent from the vertical direction to the horizontal direction, of the bracket fixing member, cover a part of the convex face of the first bracket, and thus the bracket fixing member is engaged with the first bracket.

The C-shaped groove of the bracket fixing member is configured to run through the bracket fixing member horizontally, and connecting legs opened toward the two ends of the C-shaped groove, respectively, pass through the slots provided at two sides of the supporting leg of the bracket, and thus the bracket fixing member is engaged with the first bracket.

Two ends of the groove of the bracket supporting member are configured to be in an outwardly-expanded bulge form.

The bottom face of the bracket fixing member is in a recess structure.

The bottom face of the bracket fixing member is provided at the two ends thereof with bridge structures which are titled toward the depression direction of the recess structure provided in the bottom face, and the ends of the bridge structures protrude more toward the ventilating fan body than the recess structure.

A bottom face of the bracket fixing member is provided with two openings, each comprising a larger middle portion and two ends in slit structures; and the two openings are provided horizontally, but are tilted outwardly and downwardly, respectively, and are different in orientation; the two openings each forms a tilting structure with respect to the bottom of the bracket fixing member; the bracket fixing member is fixed to the ventilating fan body by passing screws through the larger middle portion and the openings in the ventilating fan body.

A bottom face of the bracket fixing member is provided with two openings, each comprising a larger middle portion and two ends in slit structures; and the two openings are provided horizontally, but are tilted outwardly and downwardly, respectively, and are different in orientation; the two openings each forms a tilting structure with respect to the bottom of the bracket fixing member; the ventilating fan body is provided with protruding sheets, and the sheets pass through the elongate openings, each comprising the larger middle hole and the slit structures of the two ends, of the bracket fixing member, so that the bracket fixing member is fixed to the ventilating fan body by means of riveting.

The bracket fixing member is fixed in such manner that the bracket fixing member is configured to be close to an end of a side of the ventilating fan body, while the outer bottom face of the C-shaped groove of the bracket fixing member is in contact with the side of the ventilating fan body.

The bracket fixing member is fixed onto a side of the ventilating fan body at the outside deviating from the center thereof, and is mounted at a diagonal end of the side opposite to the ventilating fan body.

The mounting bracket assembly for a ventilating fan of the present invention is advantageous in that it has improved stability, simplified operation, and can be installed conveniently. Furthermore, it meets the different mounting requirements from different users.

DETAILED DESCRIPTION OF THE PREFERRED EMBODIMENT

Figure 1:
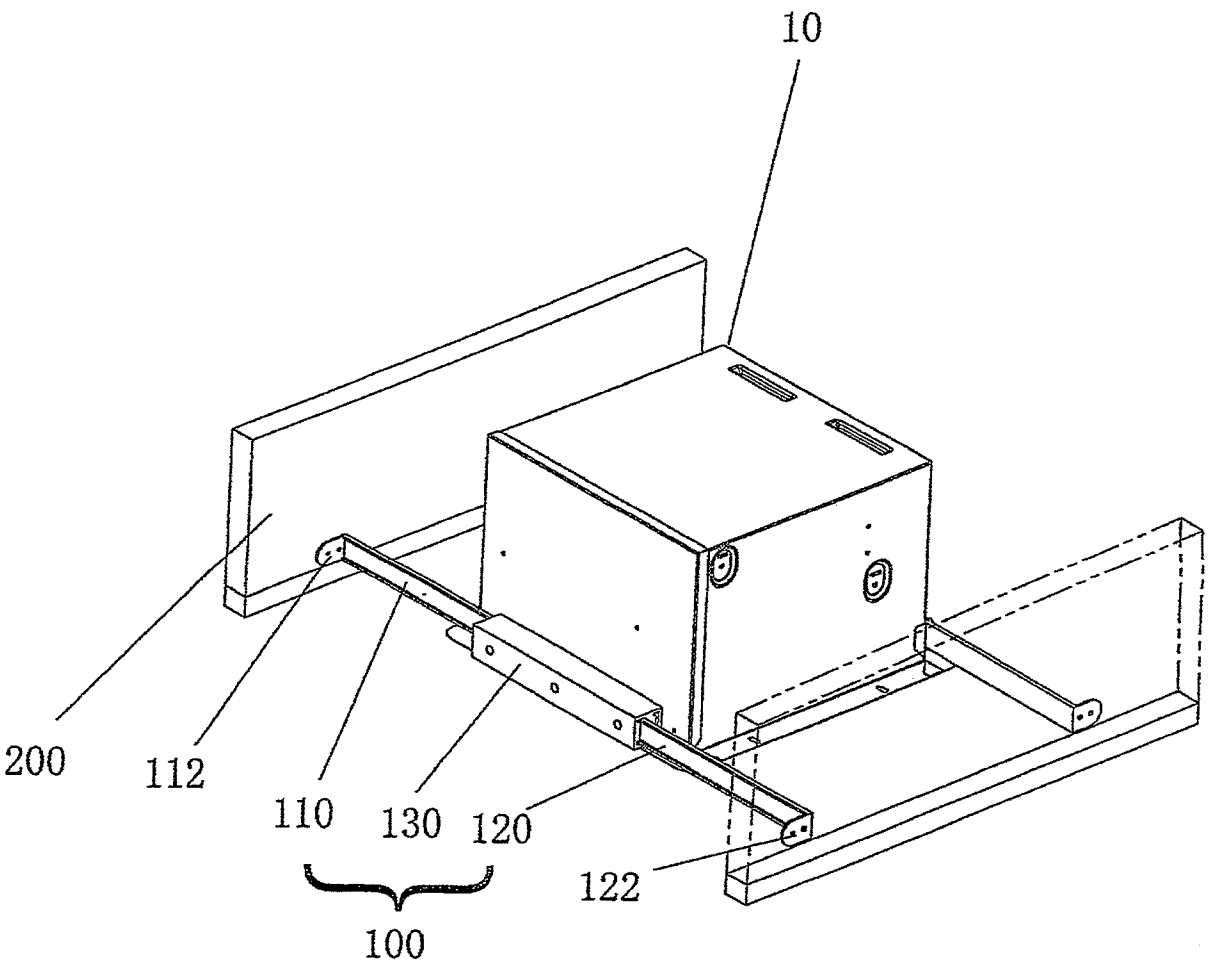
prior art Fig. 1
FIG. 1 is a schematic view of the prior art.
Figure 2:
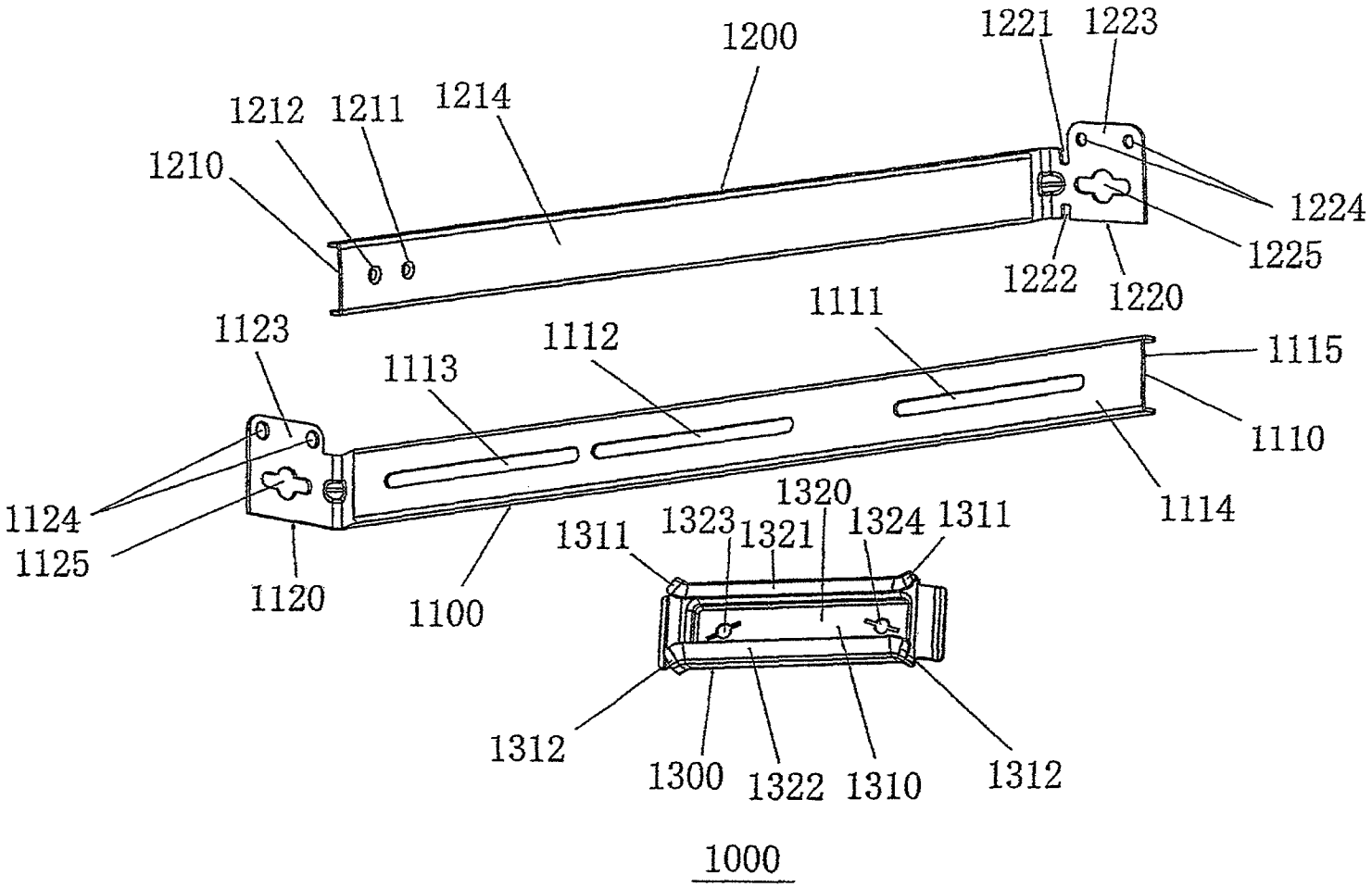
FIG. 2 is a schematic exploded view of a first bracket, a second bracket, and a bracket fixing member according to the present invention.

FIG. 2 shows a schematic exploded view of a first bracket, a second bracket, and a bracket fixing member according to the present invention. The mounting bracket assembly for a ventilating fan 1000 according to the present invention comprises a first bracket 1100, a second bracket 1200, and a bracket fixing member 1300.

The first bracket 1100 is provided with a first U-shaped groove 1110 and is provided at an end thereof with a first supporting leg 1120 folded as in an L-shape. The second bracket 1200 is provided with a second U-shaped groove 1210 and is provided at an end thereof with a second supporting leg 1220 folded as in an L shape. The U-shaped groove 1110 of the first bracket 1100 is provided with a convex face 1114 and a concave face 1115, used as an outside and an inside, respectively. A convex face 1214 of the second U-shaped groove 1210 of the second bracket 1200 has a narrower width compared to the concave face 1115 of the first U-shaped groove 1110 of the first bracket 1100. The end of the second bracket 1200, at which the second supporting leg 1220 is not provided, can be inserted into the first U-shaped groove 1110 of the first bracket 1100, that is, the inside of the concave face 1115 of the first bracket 1100 and the outside of the convex face 1214 of the second bracket 1200 are engaged with each other. Furthermore, the second bracket 1200 can be slidable into the first U-shaped groove 1110 of the first bracket 1100 and can horizontally adjust the extended length of the second bracket 1200 from the first U-shaped groove 1110 of the first bracket 1100, i.e., adjusting the length of the bracket assembly 1000.

A first elongated opening 1111, a second elongated opening 1112, and a third elongated opening 1113 formed along the horizontal direction and through the convex face 1114 and the concave face 1115 of the first U-shaped groove 1110 of the first bracket 1100 are provided. The first elongated opening 1111, the second elongated opening 1112, and the third elongated opening 1113 separately provided as above are used for ensuring strength of the first bracket 1100. In other words, if a long opening extending across the whole horizontal length of the first bracket 1100 is formed, the strength of the first bracket 1100 will be weakened. A first hole 1211 and a second hole 1212 are provided in the convex face 1214 of the second bracket 1200. After the length of the bracket assembly 1000 is adjusted according to actual requirements, the first bracket 1100 and the second bracket 1200 are connected to each other by passing screws from one of the first elongated opening 1111, the second elongated opening 1112, and the third elongated slot 1113 of the first bracket 1100 through the first hole 1211 and the second hole 1212 of the second bracket 1200, so that the adjusted length of the bracket assembly 1000 is fixed.

The bracket fixing member 1300 is provided with a C-shaped groove 1310. Two horizontal end faces of the C-shaped groove 1310, formed by bending upper and lower ends of the bracket fixing member 1300 from the vertical direction to the horizontal direction, cover a part of the convex face of the first bracket, and therefore the C-shaped groove 1310 is engaged with the first bracket. Furthermore, the C-shaped groove 1310 is configured to run through the bracket fixing member 1300 horizontally and forms connecting legs 1311 and 1312 opened toward the two ends thereof, respectively.

The connecting legs 1311 and 1312 formed at the two ends of the C-shaped groove 1310 are configured to be in an outwardly-expanded bulge form. When mounting the bracket fixing member 1300 after combining the first bracket 1100 and the second bracket 1200, the two connecting legs 1311 and 1312 at one end of the bracket fixing member 1300 pass through slots 1221 and 1222 provided at two sides of the root portion of the second supporting leg 1220 of the second bracket 1200, so that the combined first bracket 1100 and the second bracket 1200 are engaged with each other and inserted into the C-shaped groove 1310 of the fixing member and can be slidable within the C-shaped groove 1310. The horizontal end faces 1321 and 1322, formed by bending upper and lower ends of the bracket fixing member 1300 from the vertical direction to the horizontal direction, cover a part of the convex face 1114 of the first bracket 1100, and therefore the bracket fixing member 1310 is engaged with the first bracket 1100. That is, the bracket fixing member 1300 and the first bracket 1100 are engaged with each other, thereby the combined first bracket 1100 and second bracket 1200 are fixed to the ventilating fan body 1.

Figure 3:
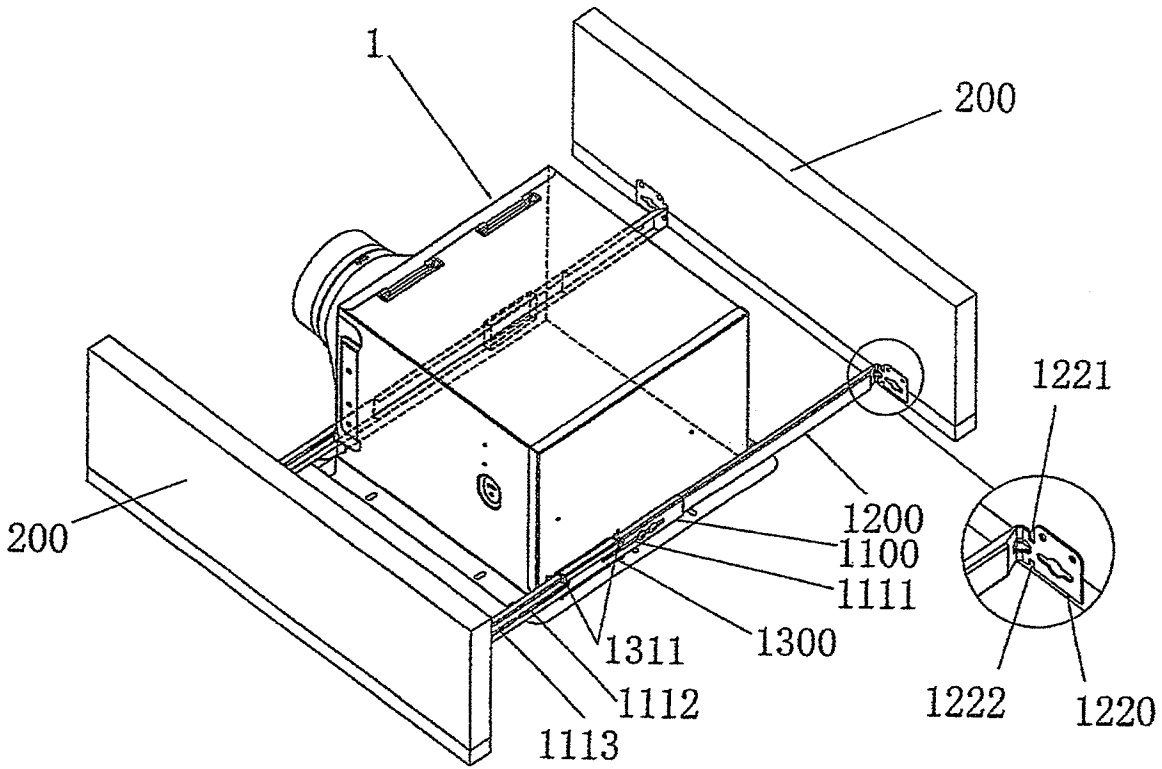
FIG. 3 is a schematic illustration showing the operation of mounting the ventilating fan according to the present invention.

FIG. 3 shows an operation of mounting the ventilating fan according to the present invention. When mounting the ventilating fan to a joist 200, the bracket fixing member 1300 is first fixed to an end of a side of the ventilating fan body 1, e.g., the left end as shown in FIG. 3. Then, the end of the second supporting leg 1220 of the second bracket 1200, and hence the first bracket 1100 and the second bracket 1200 combined into a unit, are inserted into the C-shaped groove 1310 of the bracket fixing member 1300 from the left side of the ventilating fan body 1. The left end of a side of the ventilating fan body 1 as shown in FIG. 3 indicates the left end of the side of the body 1 observed in a plan view. Since the L-shaped second supporting leg 1220 of the second bracket 1200 is provided with the slots 1221 and 1222, the second supporting leg 1220 of the second bracket 1200 and hence the first bracket 1100 and the second bracket 1200 combined into a unit can be inserted into the C-shaped groove 1310 of the bracket fixing member 1300, thereby smoothly passing through the C-shaped groove 1310 of the bracket fixing member 1300. Furthermore, since the connecting legs 1311, 1312 provided at the two ends of the C-shaped groove 1310 of the bracket fixing member 1300 are in an outwardly-expanded bulge form, the first bracket 1100 can be ensured to smoothly slide in the bracket fixing member 1300.

As shown in FIG. 2 and FIG. 3, the width relationship between the first bracket 1100, the second bracket 1200, and the bracket fixing member 1300 is (the inside width of the C-shaped groove 1310 of the bracket fixing member 1300)> (the width of the convex face 1114 of the first bracket 1100) >(the width of the concave face 1115 of the first bracket 1100)>(the width of the convex face 1214 of the second bracket 1200).

When the bracket fixing member 1300 and the second bracket 1200 are engaged with each other, a larger gap between the second bracket 1200 and the bracket fixing member 1300 occurs in the C-shaped groove 1310, resulting in reduction of stability. Therefore, the bracket fixing member 1300 must be accurately engaged to the first bracket 1100. In this embodiment, since the bracket fixing member 1300 is fixed to the left side of the ventilating fan body 1, the first bracket 1100 and the second bracket 1200 combined into a unit are inserted into the bracket fixing member 1300 from the left side of the ventilating fan body 1 in order to avoid obstruction or interference with the ventilating fan body 1. At this time, since only the root portion of the second supporting leg 1220 of the second bracket 1200 is provided in a indented shape, i.e., forming the slots 1221 and 1222, the insertion direction will not be wrong as long as the second supporting leg 1220 of the second bracket 1200 is regarded as a right-side member to be inserted into the bracket fixing member 1300, and the first bracket 1100 is regarded as a left-side member to be engaged into the bracket fixing member 1300 fixed to the left end of the ventilating fan body 1. That is to say, since the first bracket 1100 and the second bracket 1200 are first combined together and then are inserted into the bracket fixing member 1300, there is no need to insert the bracket fixing member 1300 from the ends, without supporting legs, of respective brackets. Furthermore, if as the prior art, the respective brackets are separately inserted and fixed, there is a possibility that the left and right configuration directions of the respective brackets may be wrong. With this invention, the two brackets are combined together in advance, causing correct configuration directions.

Further, screws pass through any one of the first elongated opening 1111, the second elongated opening 1112, and the third slot 1113 of the first bracket 1100 and the first hole 1211 and the second hole 1212 of the second bracket 1200, and the screws can be slid into any one of the first elongated opening 1111, the second elongated opening 1112, and the third elongated opening 1113 of the first bracket 1100. In this way, the two brackets are slidable with respect to each other within a predetermined distance after they are brought into engage with each other. When the two brackets are slid to an appropriate mounting position, the first bracket 1100 and the second bracket 1200 are connected together by tightening the screws. Then, the ventilating fan is fixed to the joist 200 by means of the L-shaped first supporting leg 120 and the L-shaped supporting leg 1220 provided at the opposite ends of the two brackets.

In this embodiment, the first bracket 1100 is provided with a plurality of elongated openings, i.e., the first elongated opening 1111, the second elongated opening 1112, and the third elongated opening 1113; the second bracket 1200 is provided with a plurality of holes, i.e., the holes 1211 and 1212. Thus, two screws can be used to pass through any one of the first elongated opening 1111, the second elongated opening 1112, and the third elongated opening 1113 of the first bracket 1100 and the holes 1211 and 1212 of the second bracket 1200, and the screws can be slidable in any one of the first elongated opening 1111, the second elongated opening 1112, and the third elongated opening 1113 of the first bracket 1100. In this way, the two brackets are brought to engage with each other and can be slidable with respect to each other within a predetermined distance. When the two brackets are slid to an appropriate mounting position, the first bracket 1100 and the second bracket 1200 are connected together by tightening the screws. Since a plurality of elongated openings, i.e., the first elongated opening 1111, the second elongated opening 1112, and the third elongated opening 1113 are provided, the sliding range can be extended. At least one of the gaps provided between the respective elongated openings of the first bracket 1100 is narrower than the gap between the two openings 1211 and 1212 of the second bracket 1200. For example, as shown in FIG. 2, the gap between the third elongated opening 1113 and the second elongated opening 1112 of the first bracket 1100 is narrower than the gap between the first hole 1211 and the second hole 1212 of the second bracket 1200. In this way, the screws can be tightened across the two elongated openings, i.e., the third elongated opening 1113 and the second elongated opening 1112, thereby improving mounting flexibility of the ventilating fan.

Further, in a case where connection strength can be ensured, it is possible to use one screw to implement fixing at one position. In that case, according to the gaps between the respective elongated openings, even if one screw hole corresponding to one elongated opening is blocked, the other screw hole corresponding to the other elongated opening will not be blocked, so that fixing can be implemented in a larger range by means of screws.

That is to say, in order to ensure the maximum adjustment range and strength, the number of the screws could be increased, and the number of the screw holes could be preferably one more greater than the number of the screws.

In this embodiment, description is implemented with reference to two screws. In order to expand the adjustment range of the brackets, three screw holes can be provided.

Figure 4:
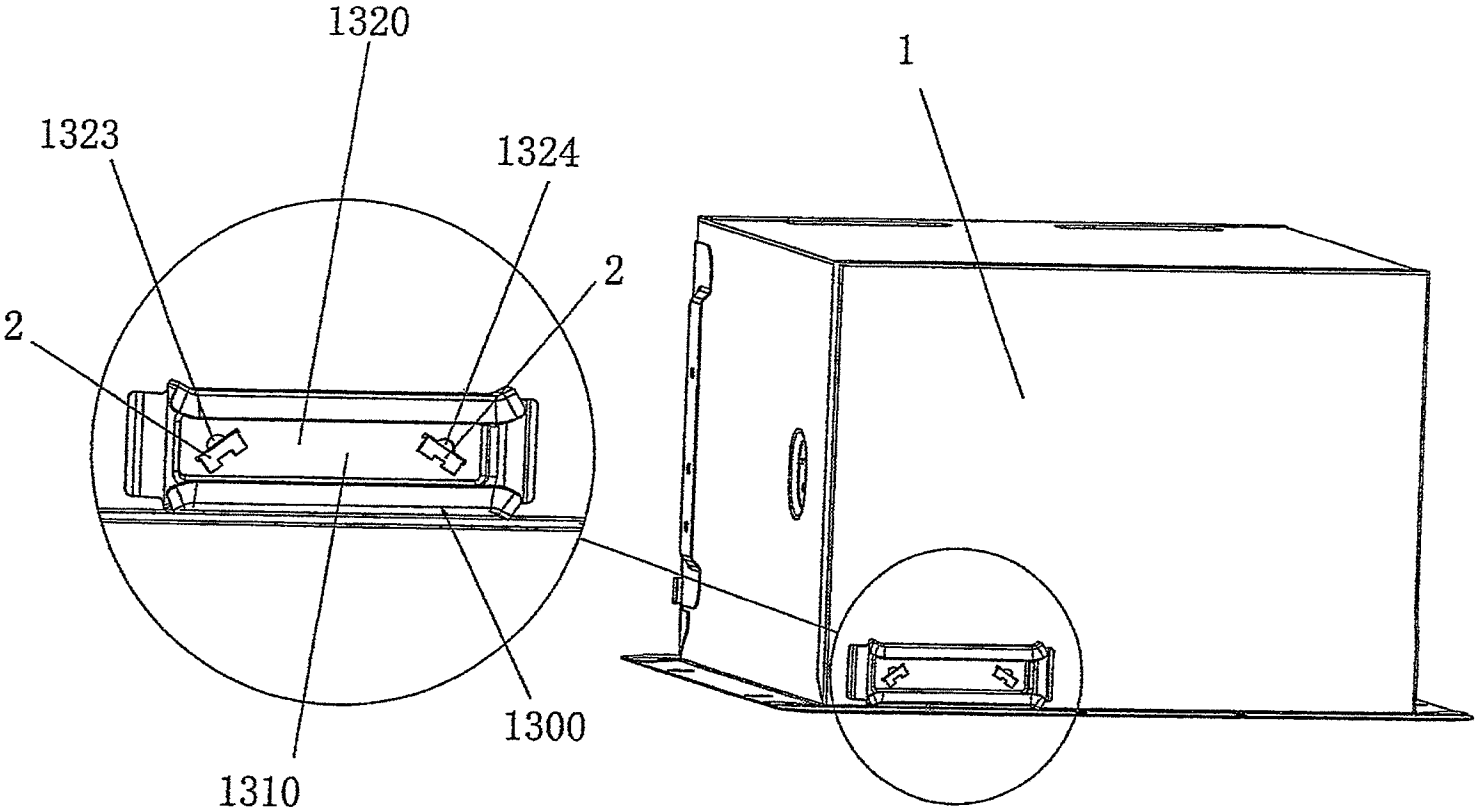
FIG. 4 is a schematic structural view showing a fixing member and the ventilating fan before assembly according to the present invention.
Figure 5:
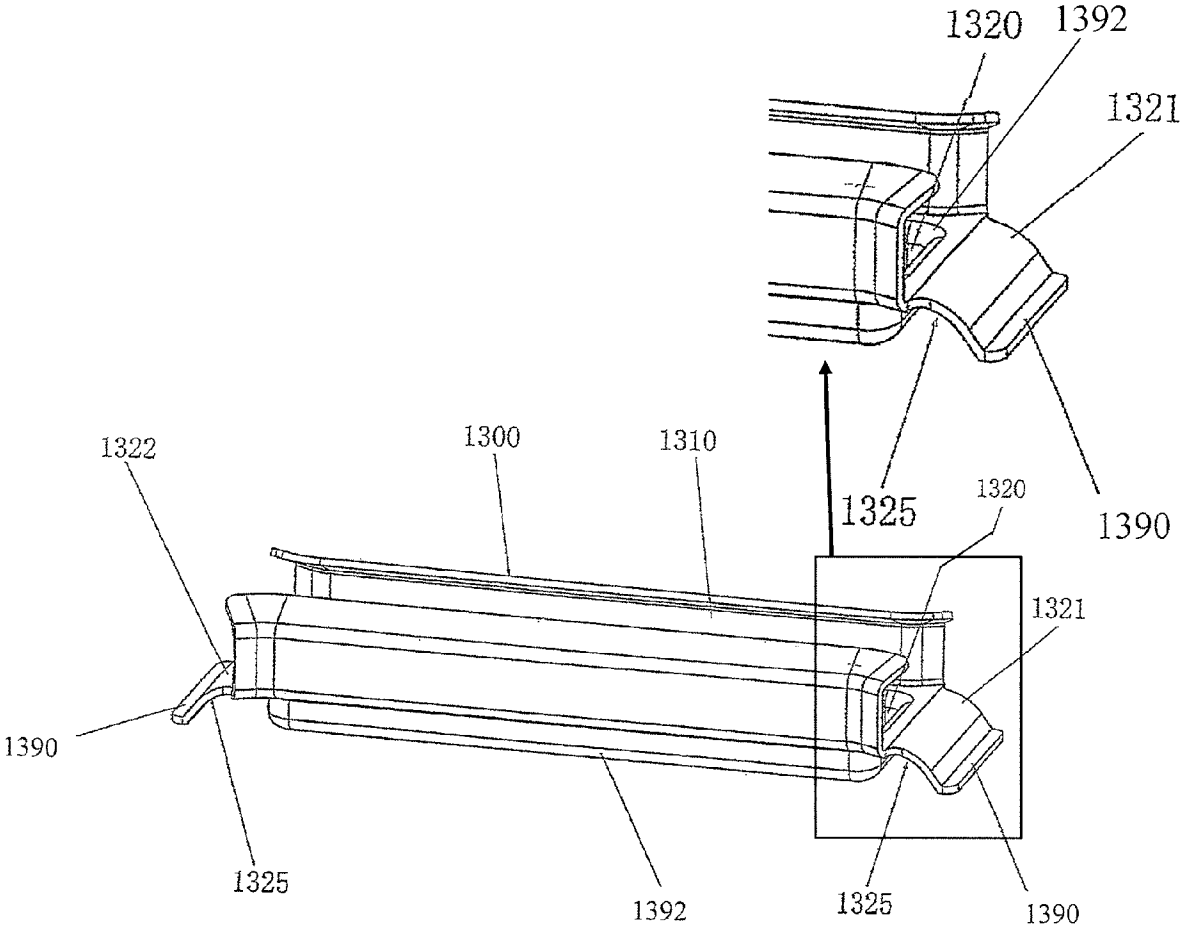
FIG. 5 is a schematic structural view of the bracket mounting member according to the present invention.

With reference to FIGS. 2, 4, and 5 (especially FIG. 5), the bottom face 1320 of the bracket fixing member 1300 is in a recess structure. The bottom face 1320 of the bracket fixing member 1300 is also provided with two openings 1323 and 1324, each comprising a wider middle portion and two ends in slit structures. The two openings 1323 and 1324 are provided horizontally, but the slit structures each is tilted outwardly and downwardly, so that the two slit structures of the two ends are different in orientation and each forms a tilting structure with respect to the bottom face 1320 of the bracket fixing member 1300.

FIG. 4 is a schematic structural view of fixing the bracket fixing member and the ventilating fan before mounting the ventilating fan body according to the present invention. As shown in FIG. 4, in this embodiment, the ventilating fan body 1 is provided with protruding sheets 2. The sheets 2 pass through the elongate openings 1323 and 1324, each comprising the wider middle hole and the slit structures of the two ends, of the bracket fixing member 1300, as a result, the bracket fixing member 1300 is fixed to the ventilating fan body 1 by means of riveting. The openings 1323 and 1324 of the bracket fixing member 1300 are in tilting structures which are tilted outwardly and downwardly, respectively. Since the openings 1323 and 1324 are tilted along the different directions, the ventilating fan body 1 is prevented from sliding down due to gravity, compared with the case where the openings 1323 and 1324 are vertically provided. The load-bearing area formed by engagement of the tilted structure of the openings 1323 and 1324 with the protruding sheets 2 is a square area with the elongated openings 1323 and 1324 being a diagonal. Compared with the case where the slit structure is a horizontal structure arranged along the horizontal direction or the case where the slit structure is a vertical structure arranged along the vertical direction, since the area of the load-bearing area caused by the tilting structure is larger than that caused by the horizontal structure, the fixing strength caused by the tilting structure is larger than that caused by the horizontal structure.

If no protruding sheet is used, the bracket fixing member 1300 can be fixed to the ventilating fan body 1 by passing screws through the wider middle portion and the openings in the ventilating fan body. After being mounted, the outer bottom face of the C-shaped groove 1310 of the bracket fixing member 1300 is in contact with a side of the ventilating fan body 1, and the bracket fixing member 1300 is fixed in such manner that the bracket fixing member 1300 is arranged to be close to an end of the side of the ventilating fan body 1, and as shown in FIG. 4, in this embodiment, the bracket fixing member 1300 is arranged to be close to the left end. The bracket fixing member 1300 is fixed onto the ventilating fan at the outside deviating from the center thereof, and is provided at a diagonal end of the side opposite to the ventilating fan body 1. Since the bracket fixing member 1300 is provided at the diagonal end of the side opposite to the ventilating fan body 1, when the center of gravity of the ventilating fan body offsets to left side or right side, the arrangement in which two bracket fixing members 1300 are arranged diagonally tends to maintains the center of gravity more easily, compared with the arrangement in which the bracket fixing member is arranged at the center of two opposite sides of the ventilating fan body 1. Therefore, compared with the case where the bracket fixing member 1300 is fixed at the center, the stability of the bracket fixing member 1300 can be ensured even if the bracket fixing member 1300 is provided to be shorter.

Further, since the bottom face 1320 of the bracket fixing member 1300 is in a recess structure, a turnbuckle can be prevented from interfering with the tips of screws used for combining the first bracket 1100 and the second bracket 1200 together (which otherwise causes the first bracket not to be inserted or slid) when the bracket fixing member 1300 is fixed to the side of the ventilating fan body 1 from the bottom face of the C-shaped groove 1310 to the side of ventilating fan body by means of screws. Furthermore, the strength of the bracket fixing member 1300 can be enhanced to prevent deformation.

With reference to FIG. 5 again, the bottom face 1320 is provided at the two ends thereof with bridge structures 1325 which are tilted toward the depression direction of the recess structure 1392. The ends 1321 and 1322 of the bridge structures 1325 protrude more toward the ventilating fan body 1 than the recess structure 1392. The ends 1321 and 1322 of the bridge structures 1325 are folded to form planar portions 1390. Since such planar portions 1390 protrude more than the recess structure 1392, when the bracket fixing member 1300 is fixed to the side of the ventilating fan body 1 by means of screws and so on, the planar portions 1390 provided at the two ends of the bridge structures 1325 will first contact with the side of the ventilating fan. The screws are then tightened from the bottom face 1320 of the C-shaped groove 1310 of the bracket fixing member 1300 to fix the bracket fixing member 1300 to the side of the ventilating fan, and thus the outer bottom face of the recess structure 1392 of the bracket fixing member 1300 is arranged to be close to and is bonded to the side of the ventilating fan made of a flexible metal plate by means of pressure welding. As a result, the recess structure 1392 of the bracket fixing member 1300 and the ends 1321 and 1322 of the bridge structures 1325 are fixed to the side of the ventilating fan body, so that the stability is improved. Therefore, even if the bracket fixing member 1300 is shorter than the existing fixing member, its stability can be ensured.

With reference to FIG. 2 again, in the present invention, the first bracket 1100 is provided at an end thereof with a flange portion 1123 having two holes 1124 thereon, and the second bracket 1200 is provided at an end thereof with a flange portion 1223 having two holes 1224 thereon. The flange portions 1123 and 1223 are provided to extend from a central opening 1125 of the supporting leg 1120 of the first bracket 1100 and the other central opening 1225 of the supporting leg 1220 of the second bracket 1200 and are provided with two smaller holes 1124 and 1224, respectively. In this way, the first supporting leg 1120 and the second supporting leg 1220 are fixed at three points, and hence the stability of the bracket is further enhanced.

At this time, the flange portion should be oriented in an upward direction in its correct position. In this way, the ventilating fan body can be mounted in the two cases as follows: 1. if the ceiling is first mounted and the ventilating fan is then mounted, the bracket is fixed to the joist (the ceiling does not bear any force) only by means of screw holes of the above-described flange portion; and 2. if the ventilating fan is first mounted, the bracket is fixed to the joist only be means of screw holes of the supporting legs or by means of the above described three points.

When the first bracket 1100 and the second bracket 1200 combined together are inserted into the bracket fixing member 1300 from an end of the C-shaped groove 1310 of the bracket fixing member 1300, the orientation of the flange portion 1123 also functions to guide the first bracket 1100 and the second bracket 1200, so that the first bracket 1100 and the second bracket 1200 can be easily inserted along the correct arrangement direction, and therefore the stability and practicability of the bracket fixing member can be improved.

What is claimed is:

1. A mounting bracket assembly for a ventilating fan, comprising a first bracket, a second bracket, and a bracket fixing member, characterized in that:

the first bracket is provided with a U-shaped groove and is provided at an end thereof with a first supporting leg folded into an L-shape;

the second bracket is provided with a U-shaped groove and is provided at an end thereof with a second supporting leg folded into an L-shape, and a root portion of the second supporting leg is provided at two sides thereof with slots;

the second bracket is engaged into the U-shaped groove of the first bracket and can be slidable in the U-shaped groove of the first bracket to adjust a length of the bracket assembly;

the bracket fixing member is provided with a C-shaped groove;

the first bracket and the second bracket combined together are engaged and inserted into the C-shaped groove of the bracket fixing member from a side of the C-shaped groove of the bracket fixing member and can be slidable in the C-shaped groove;

the bracket fixing member is engaged with the first bracket by the C-shaped groove and the first bracket and the second bracket combined together are configured to be fixed to a ventilating fan body;

a bottom face of the bracket fixing member is in a recess structure;

the bottom face of the bracket fixing member is provided at two ends thereof with bridge structures which are tilted downward, and ends of the bridge structures are configured to protrude more toward the ventilating fan body than the recess structure.

2. The mounting bracket assembly for a ventilating fan according to claim 1, characterized in that:

the first bracket is provided with a concave face on the U-shaped groove, a convex face opposite the concave face, on an opposite side of the U-shaped groove, and elongated openings formed along a horizontal direction and through the convex face and the concave face;

a convex face of the second bracket has a width that is narrower than a width of the concave face of the U-shaped groove of the first bracket, and the convex face of the second bracket is provided with holes;

the convex face of the second bracket and the concave face of the U-shaped groove of the first bracket overlap each other;

the first bracket and the second bracket are connected by passing screws from the elongated openings of the first bracket through the holes of the second bracket.

3. The mounting bracket assembly for a ventilating fan according to claim 2, characterized in that:

the elongated openings of the first bracket comprise a plurality of elongated openings;

the holes of the second bracket comprise a plurality of holes;

a gap between at least two elongated openings of the plurality of elongated openings of the first bracket is narrower than a gap between two holes of the second bracket.

4. The mounting bracket assembly for a ventilating fan according to claim 1, characterized in that: a side of the first supporting leg of the first bracket and a side of the second support leg of the second bracket are provided with a flange portion, respectively, having holes thereon.

5. The mounting bracket assembly for a ventilating fan according to claim 1, characterized in that: two horizontal end faces, formed by being bent from a vertical direction to a horizontal direction, of the bracket fixing member, cover a part of a convex face of the first bracket, and thus the bracket fixing member is engaged with the first bracket.

6. The mounting bracket assembly for a ventilating fan according to claim 1, characterized in that: the C-shaped groove of the bracket fixing member is configured to run through the bracket fixing member horizontally, and connecting legs of the bracket fixing member opened toward two ends of the C-shaped groove, respectively, pass through the slots provided at two sides of the supporting leg of the second bracket, and thus the bracket fixing member is engaged with the second bracket.

7. The mounting bracket assembly for a ventilating fan according to claim 1, characterized in that: two ends of the C-shaped groove of the bracket fixing member are configured to be in an outwardly-expanded bulge form.

8. The mounting bracket assembly for a ventilating fan according to claim 1, characterized in that: the bracket fixing member is fixed in such manner that the bracket fixing member is arranged to be close to an end of a side of the ventilating fan body, while an outer bottom face of the C-shaped groove of the bracket fixing member is in contact with the side of the ventilating fan body.

9. The mounting bracket assembly for a ventilating fan according to claim 1, characterized in that: the bracket fixing member is fixed onto a side of the ventilating fan body at an outside deviating from a center thereof, and is mounted at a diagonal end of a side opposite to the ventilating fan body.

10. A mounting bracket assembly for a ventilating fan, comprising a first bracket, a second bracket, and a bracket fixing member, wherein the first bracket is provided with a U-shaped groove and is provided at an end thereof with a first supporting leg folded into an L-shape;

the second bracket is provided with a U-shaped groove and is provided at an end thereof with a second supporting leg folded into an L-shape, and a root portion of the second supporting leg is provided at two sides thereof with slots; the second bracket is engaged into the U-shaped groove of the first bracket and can be slidable in the U-shaped groove of the first bracket to adjust a length of the bracket assembly;

the bracket fixing member is provided with a C-shaped groove;

the first bracket and the second bracket combined together are engaged and inserted into the C-shaped groove of the bracket fixing member from a side of the C-shaped groove of the bracket fixing member and can be slidable in the C-shaped groove;

the bracket fixing member is engaged with the first bracket by the C-shaped groove and the first bracket and the second bracket combined together are fixed to a ventilating fan body, a bottom face of the bracket fixing member is provided with two openings, each comprising a larger middle portion and two ends in slit structures; and the two openings are provided horizontally, but each is tilted outwardly and downwardly, and the two openings are different in orientation; the two openings each forms a tilting structure with respect to the bottom face of the bracket fixing member;

the bracket fixing member is fixed to the ventilating fan body by passing screws through the larger middle portion and openings in the ventilating fan body.

11. A mounting bracket assembly for a ventilating fan, comprising a first bracket, a second bracket, and a bracket fixing member, wherein the first bracket is provided with a U-shaped groove and is provided at an end thereof with a first supporting leg folded into an L-shape;

the second bracket is provided with a U-shaped groove and is provided at an end thereof with a second supporting leg folded into an L-shape, and a root portion of the second supporting leg is provided at two sides thereof with slots; the second bracket is engaged into the U-shaped groove of the first bracket and can be slidable in the U-shaped groove of the first bracket to adjust a length of the bracket assembly;

the bracket fixing member is provided with a C-shaped groove;

the first bracket and the second bracket combined together are engaged and inserted into the C-shaped groove of the bracket fixing member from a side of the C-shaped groove of the bracket fixing member and can be slidable in the C-shaped groove;

the bracket fixing member is engaged with the first bracket by the C-shaped groove and the first bracket and the second bracket combined together are fixed to a ventilating fan body;

a bottom face of the bracket fixing member is provided with two openings, each comprising a larger middle portion and two ends in slit structures; and the two openings are provided horizontally, but each is tilted outwardly and downwardly, and the two openings are different in orientation; the two openings each forms a tilting structure with respect to the bottom face of the bracket fixing member;

the ventilating fan body is provided with protruding sheets, and the sheets pass through the two openings, of the bracket fixing member, so that the bracket fixing member is fixed to the ventilating fan body by means of riveting.

* * * * *